US011867468B2

(12) United States Patent
Kontu

(10) Patent No.: US 11,867,468 B2
(45) Date of Patent: Jan. 9, 2024

(54) PLATE HEAT EXCHANGER ARRANGEMENT

(71) Applicant: VAHTERUS OY, Kalanti (FI)

(72) Inventor: Mauri Kontu, Kalanti as. (FI)

(73) Assignee: VAHTERUS OY, Kalanti (FI)

( * ) Notice: Subject to any disclaimer, the term of this patent is extended or adjusted under 35 U.S.C. 154(b) by 144 days.

(21) Appl. No.: 17/284,389

(22) PCT Filed: Oct. 10, 2019

(86) PCT No.: PCT/EP2019/077474
§ 371 (c)(1),
(2) Date: Apr. 9, 2021

(87) PCT Pub. No.: WO2020/074641
PCT Pub. Date: Apr. 16, 2020

(65) Prior Publication Data

US 2021/0333051 A1 Oct. 28, 2021

(30) Foreign Application Priority Data

Oct. 12, 2018 (EP) ..... 18200131

(51) Int. Cl.
*F28D 9/00* (2006.01)
*F28F 9/02* (2006.01)

(52) U.S. Cl.
CPC ..... *F28D 9/0006* (2013.01); *F28D 9/0043* (2013.01); *F28D 9/0093* (2013.01); *F28F 9/027* (2013.01); *F28F 9/0209* (2013.01)

(58) Field of Classification Search
CPC .... F28D 9/0037; F28D 9/0093; F28D 9/0006; F28F 9/024
See application file for complete search history.

(56) References Cited

U.S. PATENT DOCUMENTS 6,089,313 A * 7/2000 Levy ..... F28D 9/0093 165/145
6,158,238 A * 12/2000 Lampinen ..... F28F 3/083 62/484

(Continued)

FOREIGN PATENT DOCUMENTS

CN 105358929 2/2016
FR 2846736 A1 * 5/2004 ..... F01P 9/06

(Continued)

OTHER PUBLICATIONS

Extended European Search Report for EP Application No. 18 200 131.3 dated Apr. 12, 2019, 5 pages.

(Continued)

*Primary Examiner* — Paul Alvare
(74) *Attorney, Agent, or Firm* — NIXON & VANDERHYE P.C.

(57) ABSTRACT

A plate heat exchanger arrangement includes a plate pack and an outer casing surrounding the plate pack. At least one partition plate is arranged between the heat exchange plates of the plate pack, which divides the plate pack to the separate plate pack parts. The plate heat exchanger arrangement is provided with inlet and outlet connections for each plate pack part which are arranged to connect the inner parts of the plate pairs of said plate pack part. A connection pipe is arranged inside a flow passage of the plate pack part between the end plate of the outer casing and the partition plate such that a first end of the connection pipe is attached to the partition plate to form a connection to the flow passage of the plate pack part and a second end thereof extends through an end plate of the outer casing.

13 Claims, 5 Drawing Sheets

(56) References Cited

U.S. PATENT DOCUMENTS

| | | | | |
|---|---|---|---|---|
| 6,168,765 | B1 * | 1/2001 | Romatier | F28F 3/04 165/DIG. 356 |
| 6,536,511 | B1 * | 3/2003 | Nilsson | B01D 53/22 62/93 |
| 9,429,367 | B2 * | 8/2016 | Jouanny | F28D 9/005 |
| 10,619,944 | B2 | 4/2020 | Cole et al. | |
| 10,989,481 | B2 * | 4/2021 | Crawford | F28D 9/0093 |
| 2002/0179295 | A1 | 12/2002 | Palanchon | |
| 2005/0011639 | A1 * | 1/2005 | Kontu | F28F 13/06 165/167 |
| 2006/0118284 | A1 * | 6/2006 | Tauren | F28F 9/22 165/157 |
| 2007/0125527 | A1 * | 6/2007 | Flik | F28D 7/1692 165/140 |
| 2012/0060550 | A1 * | 3/2012 | Mann | F28D 9/0093 62/513 |
| 2012/0216562 | A1 * | 8/2012 | Kadle | F28D 9/0093 62/434 |
| 2013/0292099 | A1 * | 11/2013 | Cook | F28F 9/026 165/145 |
| 2013/0306283 | A1 * | 11/2013 | Bader | F28D 9/005 165/166 |
| 2015/0129181 | A1 * | 5/2015 | John | F28D 9/0093 165/157 |
| 2015/0325889 | A1 | 11/2015 | Jung et al. | |
| 2016/0025419 | A1 * | 1/2016 | Pitkänen | B23P 15/26 165/158 |
| 2018/0112935 | A1 | 4/2018 | Seo | |
| 2018/0135916 | A1 * | 5/2018 | Sueyoshi | B60H 1/00342 |

FOREIGN PATENT DOCUMENTS

| | | |
|---|---|---|
| GB | 534313 | 3/1941 |
| JP | 2011-7467 | 1/2011 |
| JP | 469529 | 11/2011 |
| JP | 2015-535069 | 12/2015 |
| JP | 2016-183833 | 10/2016 |
| JP | 2017-32250 | 2/2017 |
| RU | 2042911 | 8/1995 |
| WO | 2010/149858 | 12/2010 |
| WO | 2014/162041 | 10/2014 |

OTHER PUBLICATIONS

International Search Report and Written Opinion of the ISA for PCT/EP2019/077474 dated Nov. 28, 2019, 12 pages.

IN Official Action, IN Appln No. 202147021002 dated Sep. 22, 2022.

Search Report, CN Application No. 2019800671505, dated Oct. 10, 2019.

Notice of Reasons for Refusal, Japanese Patent Application No. 2021-516693, dated Oct. 3, 2023.

* cited by examiner

PLATE HEAT EXCHANGER ARRANGEMENT

This application is the U.S. national phase of International Application No. PCT/EP2019/077474 filed Oct. 10, 2019 which designated the U.S. and claims priority to EP Patent Application No. 18200131.3 filed Oct. 12, 2018, the entire contents of each of which are hereby incorporated by reference.

FIELD OF THE INVENTION

The present invention relates to a plate heat exchanger arrangement according to the independent claim presented below. The invention relates also a modular structure comprising a plate heat exchanger arrangement according to the invention.

BACKGROUND OF THE INVENTION

Plate and Shell-type plate heat exchangers are composed of a plate pack formed by heat exchange plates and an outer casing surrounding it, functioning as a pressure vessel. A plate pack is made up of several plate pairs. Each plate pair is typically formed of two heat exchange plates that are attached together at least at their outer periphery. Each heat exchange plate has at least two openings for the flow of a heat exchange medium. Adjacent plate pairs are attached to each other by attaching the openings of two adjacent plate pairs to each other. The inner parts of which plate pairs are arranged in connection with each other via flow passages formed by the openings of the heat exchange plates, wherein a primary circuit of the heat exchanger is formed between the openings in the heat exchange plates. A secondary circuit is formed between connections of the outer casing surrounding the plate pack, and they are arranged in connection with the spaces between the plate pairs of the plate pack. A heat exchange medium of the primary side flows in every other plate space and a heat exchange medium of the secondary side in every other plate space.

In some applications there might be need for several heat exchangers, but a space for the heat exchangers is limited, wherein it may be beneficial if heat exchangers can be arranged as compact as possible.

SUMMARY OF THE INVENTION

It is an object of the present invention to provide a plate heat exchanger arrangement which makes possible a compact structure of the plate heat exchanger.

It is especially an object of the present invention to provide a plate heat exchanger arrangement which makes possible to construct the flows of the multiple heat exchange mediums inside one plate pack.

It is also an object of the invention to provide a plate heat exchanger arrangement which can be used as a heat exchanger as such, but which can also be utilized in the modular structures.

Further, it is an object of the invention to provide a plate heat exchanger construction which is easy to manufacture.

In order to achieve among others the objects presented above, the invention is characterized by what is presented in the characterizing part of the enclosed independent claim. Some preferred embodiments of the invention will be described in the other claims.

A typical plate heat exchanger arrangement according to the invention comprises

- a plate pack formed by heat exchange plates having at least two openings and arranged on top of each other, which plate pack comprises ends in the direction of the heat exchange plates and an outer surface defined by the outer edges of the heat exchange plates, and in which plate pack the heat exchange plates are attached to each other as plate pairs, the inner parts of which plate pairs are arranged in connection with each other via flow passages formed by the openings of the heat exchange plates,
- an outer casing surrounding the plate pack, which outer casing comprises end plates mainly in the direction of the ends of the plate pack and a shell connecting the end plates,
- an inlet connection and an outlet connection for a heat exchange medium arranged through the outer casing, which are arranged in connection with the spaces between the plate pairs.

In a typical plate heat exchanger arrangement according to the invention at least one partition plate is arranged between the heat exchange plates of the plate pack, which divides the plate pack to the separate plate pack parts, wherein the plate heat exchanger arrangement comprises an inlet connection and an outlet connection for each plate pack part, which are arranged in connection with the inner parts of the plate pairs of said plate pack part. In a typical plate heat exchanger arrangement according to the invention at least one inlet or outlet connection of the plate pack parts comprises a connection pipe, which is arranged inside a flow passage of the plate pack part between the end plate of the outer casing and the partition plate, wherein an end of said connection pipe is attached to said partition plate for forming a connection to the flow passage of said plate pack part and a second end of said connection pipe elongates through an end plate of the outer casing.

A typical modular structure according to the invention comprises at least two modules arranged inside the same outer casing, which modules are separated from each other by a partition wall, and at least one module comprises a plate heat exchanger arrangement according to an embodiment of the present invention comprising two plate pack parts.

The present invention is based on a structure of the plate pack, which comprises two or more plate pack parts in one plate pack. A structure of a plate pack according to the invention makes possible to arrange two or more separate heat exchange medium circulations in same plate pack. It has been found that a plate pack may be divided to two or more separate parts by arranging a partition plate between the heat exchange plates of the plate pack, wherein the partition plate separates the parts of the plate pack. Two or more plate pack parts in one plate pack are possible since it has been found that an inlet and/or an outlet connection of the plate pack part can be arranged through the flow passage of the adjacent plate pack part so that the connection comprises a connection pipe inside a flow passage of the plate pack part between the end plate of the outer casing and the partition plate. An end of said connection pipe is tightly attached to a partition plate for forming a connection to the flow passage of said plate pack part, wherein the heat exchange mediums inside the plate pack parts cannot mix to each other. In a plate heat exchanger arrangement according to the present invention at least one inlet or outlet connection of the plate pack parts comprises a double connection structure, i.e. through one opening in the end plate is arranged a connection to two plate pack parts.

A plate heat exchanger arrangement for two or more heat exchange mediums inside the same plate pack can be cooled/heated by using a single heat exchange medium in the shell side of the plate heat exchanger. This is advantageous if a space for the heat exchangers is limited. A shell side inlet and outlet connections can be formed regardless of the connections of the plate pack. In a typical embodiment according to the invention the shell side is common in all plate pack parts. A shell side can be constructed simply without complex structure which e.g. simplify a pipework required for the heat exchanger arrangement according to the invention.

A plate pack structure according to the present invention provides a completely welded structure and it does not affect the pressure-tightness of the heat exchanger.

A plate heat exchanger arrangement according to an embodiment of the invention provides a compact structure since the inlet and the outlet connections of the plate pack arrangement comprising two plate pack parts are possible to arrange through one end plate of the outer casing. This kind of plate heat exchanger arrangement according to the invention can be formed with an openable end plate structure.

A plate heat exchanger arrangement according to the invention also provides easily adaptable structure.

DESCRIPTION OF THE DRAWINGS

The invention will be described in more detail with reference to appended drawings, in which.

DETAILED DESCRIPTION OF THE INVENTION

Figure 1:
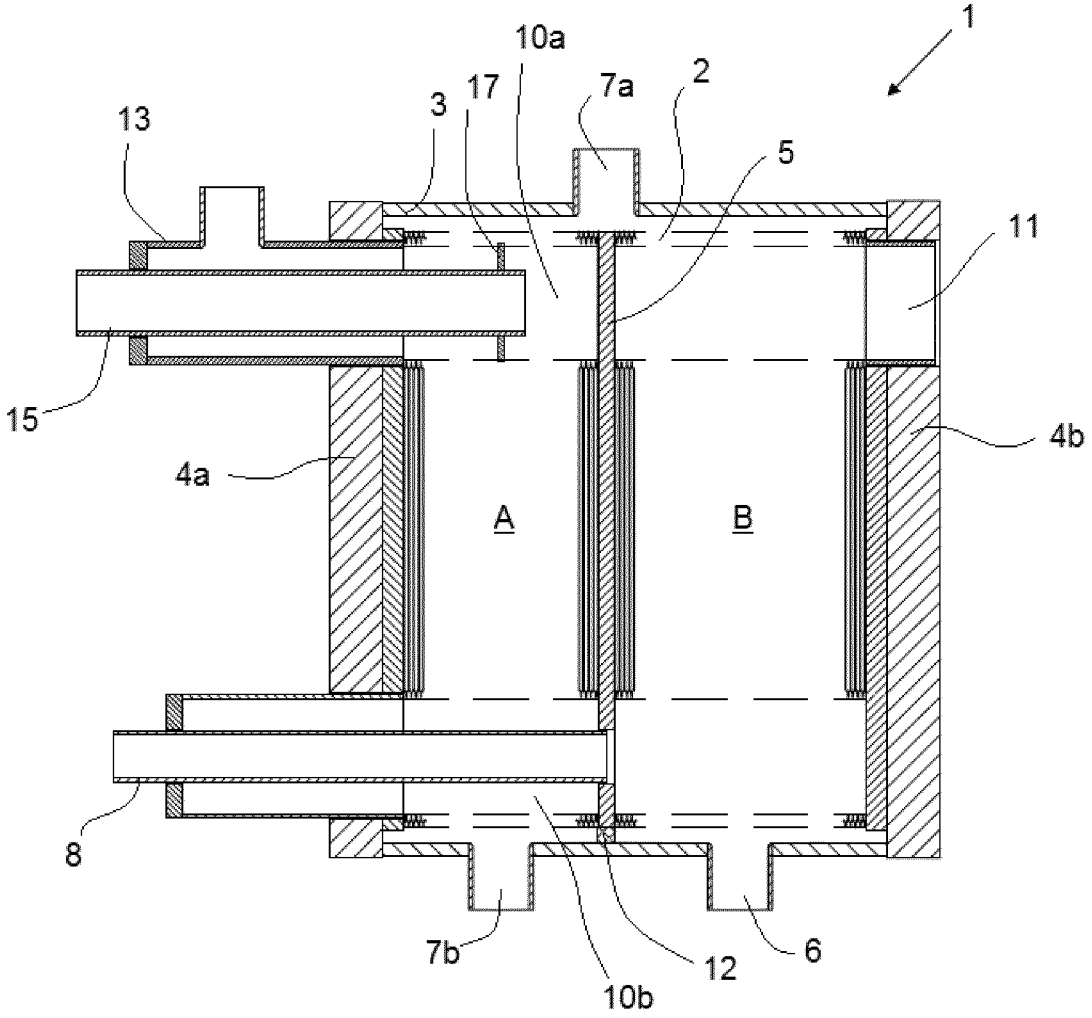
FIG. 1 shows a plate heat exchanger arrangement according to an embodiment of the present invention with one partition plate arranged into the plate pack.

A plate heat exchanger arrangement according to the invention comprises a plate pack and an outer casing surrounding it. The outer casing comprises a shell and a first end plate and a second end plate, which are arranged at the ends of the shell. In a typical embodiment the shell is a substantially horizontal cylindrical shell and the end plates are the vertical end plates. The term longitudinal direction of the outer casing or cylindrical shell used in this description refers to the direction between the end plates, typically it means the horizontal direction. If the cylindrical shell of the outer casing is a straight circular cylinder, then its longitudinal direction is the same as the direction of the central axis of the cylinder in question.

A plate pack is made up of several plate pairs. Each plate pair is typically formed of two heat exchange plates that are attached together at least at their outer periphery. Each heat exchange plate has at least two openings for a flow of a heat exchange medium. Adjacent plate pairs are attached to each other by attaching the openings of two adjacent plate pairs to each other. The inner parts of which plate pairs are arranged in connection with each other via flow passages formed by the openings of the heat exchange plates. In a plate pack, a heat exchange medium can flow from a plate pair to another via the openings. Heat exchange plates are typically circular heat exchange plates, wherein the plate pack is mainly circular cylinder in shape. A longitudinal direction of the plate pack is same as the longitudinal direction of the cylindrical shell.

In a plate heat exchanger arrangement according to the invention, a plate pack is divided two or more plate pack parts, which means that one plate pack formed of the plate pairs of the heat exchange plates comprises two or more parts comprising several the plate pairs. In a plate heat exchanger arrangement according to the invention, at least one partition plate is arranged between the heat exchange plates of the plate pack, which divides the plate pack to the separate plate pack parts. According to the present invention a plate pack may be divided to two, three or four plate pack parts by arranging partition plates between the heat exchange plates of the plate pack. The separate plate pack parts of the plate pack mean that the flow connection of the inner sides of the plate pairs inside the plate pack is blocked by the partition plate. A plate pack parts may have a different size, i.e. they may comprise a different amount of the plate pairs. The plate pack parts of the plate pack may be arranged on the basis of the requirement of an application.

According to an embodiment the partition plate arranged between the heat exchange plates of the plate pack has a thickness of about 5 to 20 mm. A partition plate is substantially thicker than the heat exchange plates of the plate pack. A partition plate is arranged between the heat exchange plates so that the outer edge of the partition plate is substantially in the same plane with the outer surface of the plate pack, i.e. a diameter of the partition plate is substantially the same as a diameter of the heat exchange plates of the plate pack. A partition plate may be welded to the heat exchange plates of the plate pack. A partition wall is used to block a flow connection between the plate pairs.

A plate heat exchanger arrangement according to the invention comprises an inlet connection and an outlet connection for each plate pack part, which connections are arranged in connection with the inner parts of the plate pairs of said plate pack part. The primary circuit of the plate pack part is thus formed between the inlet and outlet connection of said plate pack part. The inlet and outlet connections of the secondary circuit are arranged in connection with the inner side of the outer casing, in the spaces between the plate pairs. Typically, the primary circuits of the plate pack parts and the secondary circuit are separate from each other, i.e. the heat exchange medium flowing in the inner part of a plate pack part cannot get mixed with the heat exchange medium flowing in the outer casing and with the heat exchange medium flowing in the inner part of another plate pack part.

At least one inlet or outlet connection of the plate pack parts comprises a connection pipe, which is arranged inside a flow passage of the plate pack part between the end plate of the outer casing and the partition plate. An end of said connection pipe is attached to said partition plate for forming a connection to the flow passage of said plate pack part and a second end of said connection pipe elongates through an end plate of the outer casing. An end of the connection pipe is tightly attached to the partition plate for providing a tight structure and eliminating by-pass flow between the adjacent plate pack parts, although they are formed by using the same plate pack.

A connection pipe has an outer diameter smaller than a diameter of the flow passage of the plate pack part to which it is arranged, since outside of the connection pipe flows the heat exchange medium of said plate pack part. In a plate heat exchanger arrangement of the invention the plate pack parts are formed to one plate pack, wherein the diameter of the flow passages in all plate pack parts is typically same.

In an embodiment according to the invention, a plate pack comprises two separate parts, a first plate pack part and a second plate pack part, which plate pack parts are formed by arranging a partition plate between the heat exchange plates of the plate pack. A first plate pack part refers to the plate pack part, which is between the end plate of the outer casing and the partition plate and directly connected to the inlet and outlet connection arranged through the end plate of the outer casing. A second plate pack part refers to the plate pack part which is arranged behind the partition wall when seeing from the end plate comprising the inlet or outlet for the first plate pack part. An inlet and/or outlet connection of the second plate pack part comprises a connection pipe arranged inside a flow passage of the first plate pack part. An end of the connection pipe is attached to the partition plate for forming a connection to the flow passage of second plate pack part and a second end of said connection pipe elongates through an end plate of the outer casing. When both the inlet connection and the outlet connection of the second plate pack part is formed by arranging a connection pipe through the flow passages of the first plate pack part, the plate heat exchanger arrangement provides a compact structure with the openable end plate, since all inlet and outlet connection of the plate pack parts are arranged to the same end plate and therefore the plate heat exchanger arrangement can be manufactured with an openable end plate and the plate pack can be easily removed out from the outer casing, if required e.g. for cleaning.

In an embodiment according to the invention, the plate pack comprises two separate parts, a first plate pack part and a second plate pack part, and an inlet connection or an outlet connection of the second plate pack part comprise a connection pipe which is arranged inside a flow passage of the first plate pack part between the end plate of the outer casing and the partition plate. In said embodiment, an inlet connection of the first plate pack part may be formed by arranging a connection pipe through an outlet connection of the first plate pack part arranged at the end plate of the outer casing, wherein said connection pipe elongates inside the flow passage of the first plate pack part. Said inlet and outlet connections forms a double pipe connection which is arranged through the same opening at the end plate.

In an embodiment according to the invention, the plate pack comprises two partition plates, wherein the plate pack comprises three separate parts, a first plate pack part, a second plate pack part and a third plate pack part. An inlet and an outlet connection of the second plate pack part in a central part of the plate pack comprise a connection pipe which is arranged inside a flow passage of the first plate pack part and/or the third plate pack part between the end plate of the outer casing and the partition plate. An inlet and an outlet connection pipes are arranged through the flow passages of the first plate pack part and/or the third plate pack part depending on an application. In an embodiment according to the invention an inlet connection of the first plate pack part and an inlet connection of the third plate pack part are formed by arranging a connection pipe through an outlet connection of said plate pack part arranged at the end plate of the outer casing, wherein said connection pipe elongates inside the flow passage of said plate pack part.

In an embodiment according to the invention, the plate pack comprises three partition plates, wherein the plate pack comprises four separate parts, a first plate pack part, a second plate pack part, a third plate pack part and a fourth plate pack part. An inlet and an outlet connection of the second plate pack part and the third plate pack part in a central part of the plate pack comprise a connection pipe which is arranged inside a flow passage of the first plate pack part and the third plate pack part between the end plate of the outer casing and the partition plate.

A plate heat exchanger arrangement for two or more heat exchange mediums inside the same plate pack can be cooled/heated by using a single heat exchange medium in the shell side of the plate heat exchanger. A shell side inlet and outlet connections can be formed regardless of the connections of the plate pack. In a typical embodiment according to the invention the shell side is common in all plate pack parts. In the heat exchanger arrangement according to the invention an inlet and an outlet connection of the shell side is arranged through the outer casing of the heat exchanger. An inlet and an outlet connection of the shell side may be arranged through the end plate(s) or through the shell, or any combination of them. According to a preferred embodiment of the invention all the shell side inlet and outlet connections are arranged in the end plate of the heat exchanger, which may be advantageous, if also the inlet and outlet connections of the plate pack parts are arranged to the end plate. This provides a compact structure of the plate heat exchanger arrangement.

In an embodiment of the invention, a plate heat exchanger arrangement further comprises at least one stopper plate arranged between an outer surface of the plate pack and an inner surface of the shell for arranging multiple passes in the shell side of the heat exchanger. According to an embodiment of the invention the stopper plate is welded to a partition plate arranged between the heat exchange plates of the plate pack. A stopper plate is a substantially planar in the direction of the heat exchange plates and it is arranged to the plate heat exchanger structure in the direction of the heat exchange plates of the plate pack.

A plate heat exchanger arrangement according to the invention may be a heat exchanger as such, or it may be a part of the modular structure.

A modular structure according to the invention comprises at least two modules arranged inside the same outer casing, which modules are separated from each other by a partition wall, and at least one module comprises a plate heat exchanger arrangement according to invention, which arrangement comprises two plate pack parts. In an embodiment, the outer casing of the modules is continuous in the length of the modular structure. In a modular structure, a partition wall between the plate heat exchanger arrangement and the adjacent module is the end plate of the outer casing of said plate heat exchanger arrangement. The arrangement according to the invention provides a compact modular structure, since two heat exchange medium circulations can be arranged inside one module part. These kinds of the structures may be advantageous when a space for the heat exchanger applications is limited.

DETAILED DESCRIPTION OF THE DRAWINGS

For the sake of clarity, the same reference numbers are used for corresponding parts in different embodiments.

The plate heat exchanger arrangements 1 presented in Figures comprise an outer casing, which is formed of a substantially horizontal cylindrical shell 3 and substantially vertical first and second end plates 4*a*, 4*b*. A plate pack 2 is arranged inside the outer casing. The plate pack 2 is formed by heat exchange plates having two openings and arranged on top of each other, in which plate pack the heat exchange plates are attached to each other as plate pairs, the inner parts of which plate pairs are arranged in connection with each other via flow passages 10*a*, 10*b* formed by the openings of the heat exchange plates.

Figure 2:
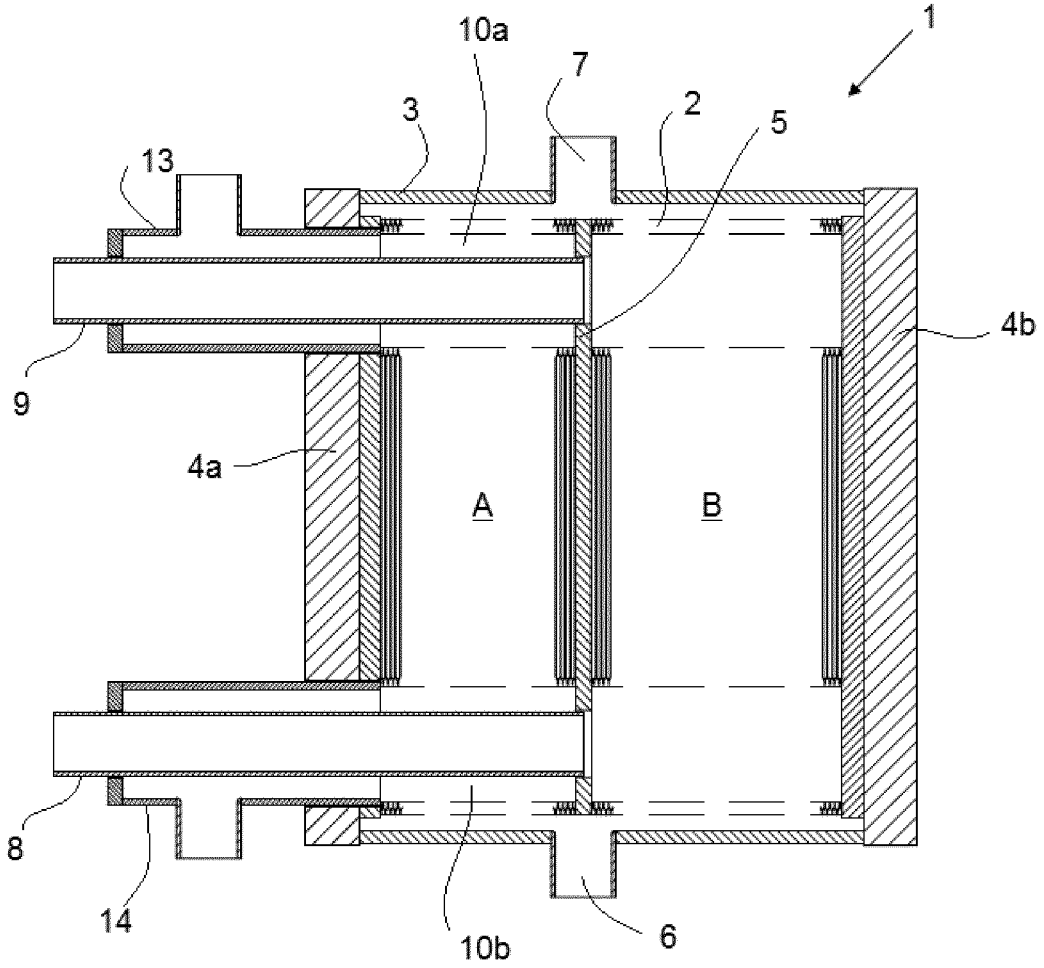
FIGS. 2 and 3 show plate heat exchanger arrangements according to other embodiments of the present invention with one partition plate arranged into the plate pack.
Figure 3:
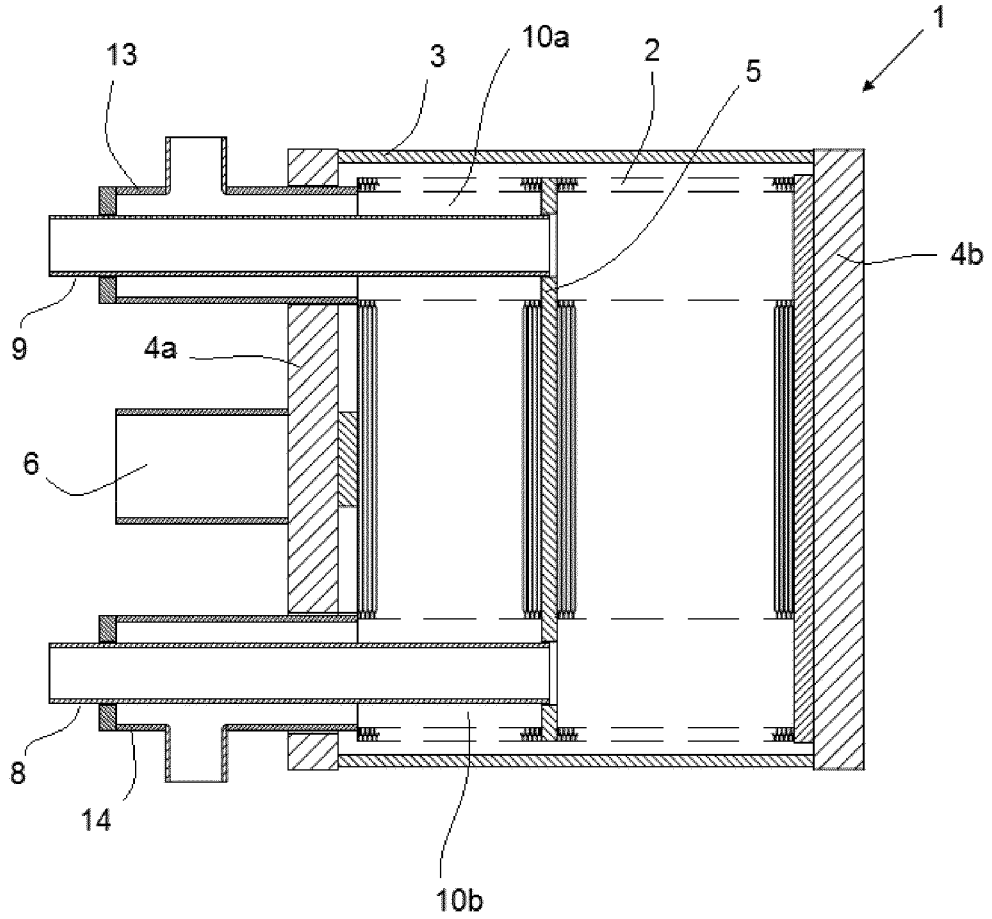

In the embodiments presented in FIGS. 1-3, a plate pack 2 comprises two plate pack parts, a first plate pack part A and a second plate pack part B. The first and the second plate pack parts are separated from each other by arranging a partition wall 5 between the heat exchange plates of the plate pack.

Figure 5:
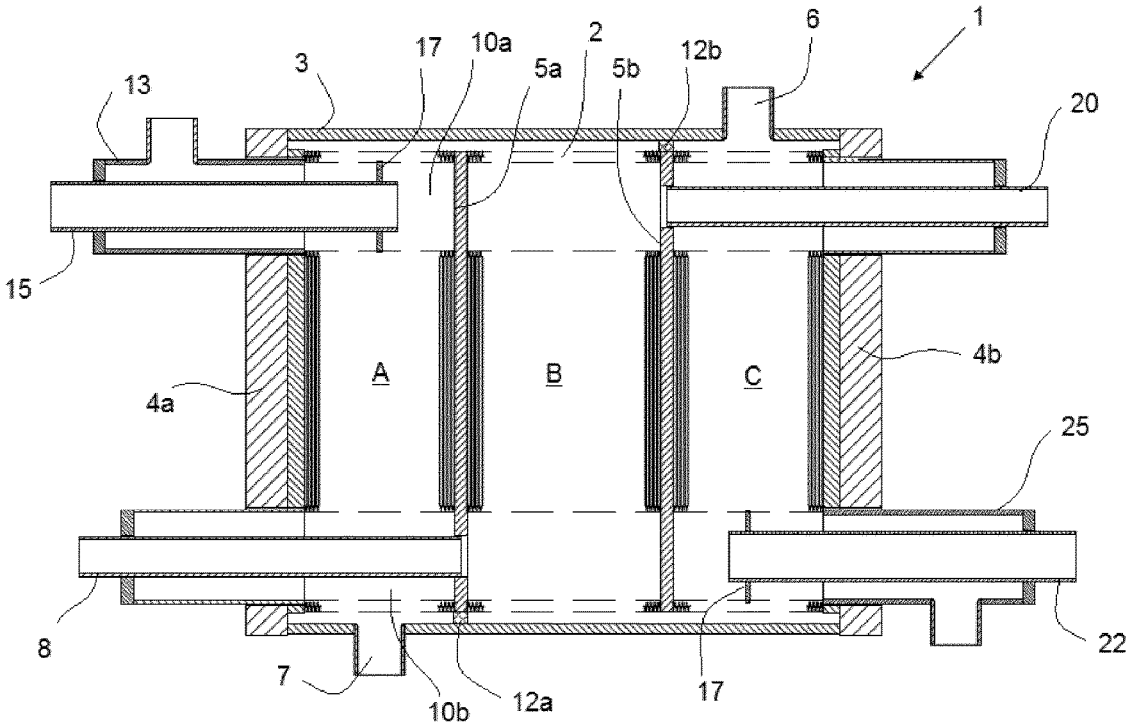
Figure 6:
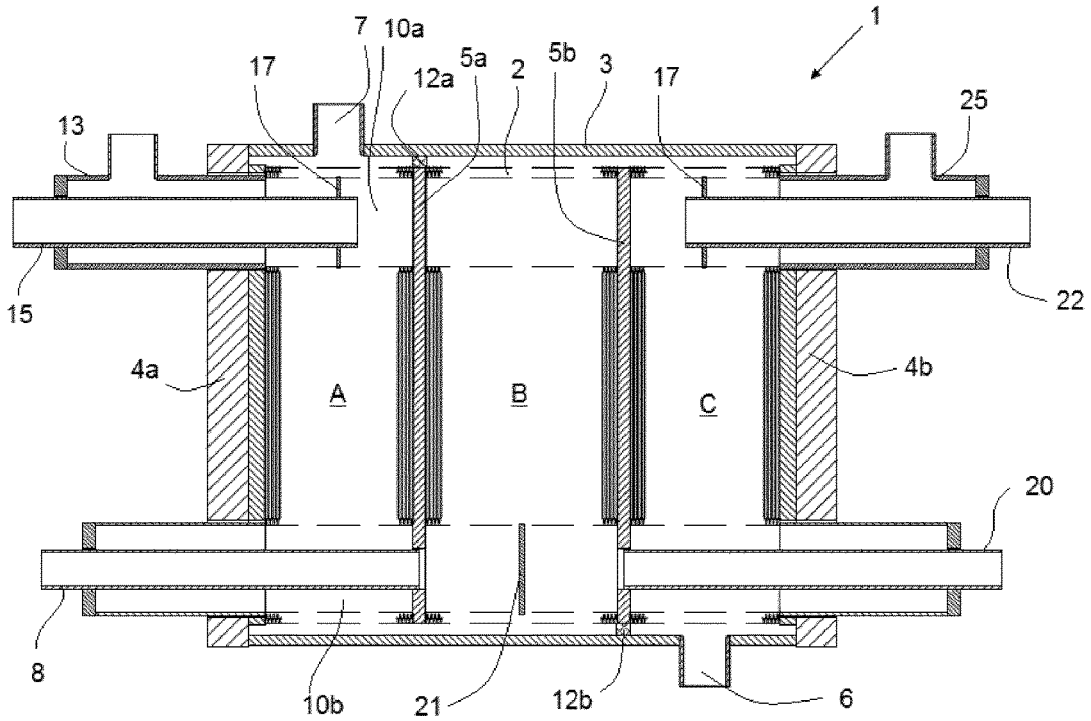

In the embodiments presented in FIGS. 5 and 6, a plate pack 2 comprises three plate pack parts, a first plate pack part A, a second plate pack part B and a third plate pack part C. The plate pack parts are separated from each other by arranging two partition walls 5*a*, 5*b* between the heat exchange plates of the plate pack.

Figure 7:
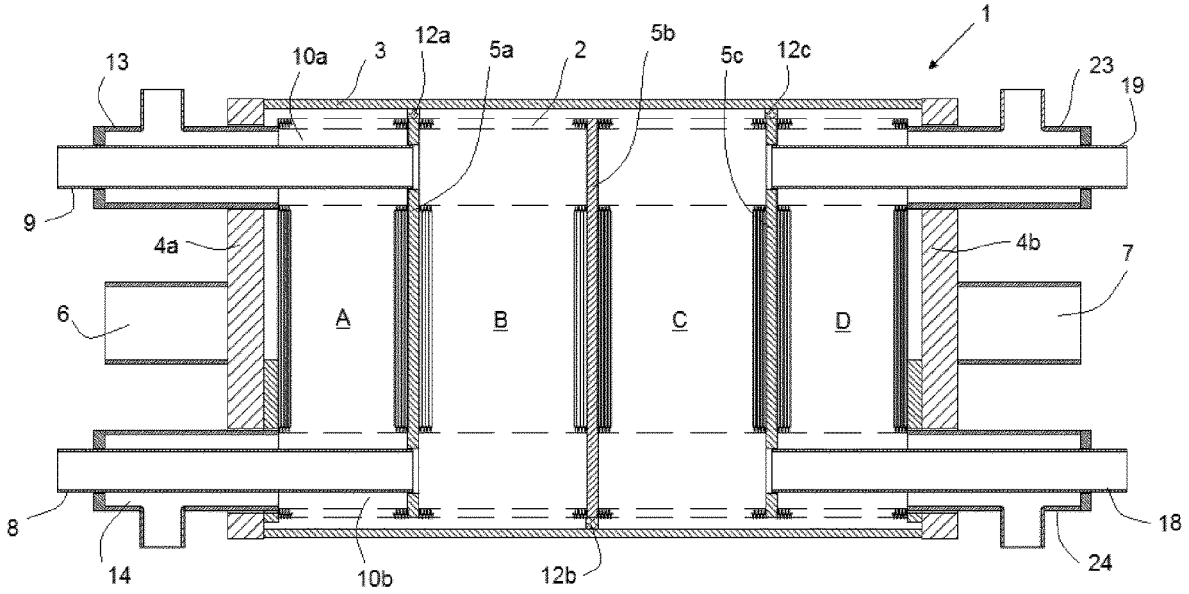
FIG. 7 shows a plate heat exchanger arrangement according to an embodiment of the present invention, with three partition plates arranged into the plate pack.

In an embodiment presented in FIG. 7, a plate pack 2 comprises four plate pack parts, a first plate pack part A, a second plate pack part B, a third plate pack part C and a fourth plate pack part D. The plate pack parts are separated from each other by arranging three partition walls 5*a*, 5*b*, 5*c* between the heat exchange plates of the plate pack.

Each plate pack part comprises several plate pairs of the plate pack 2. A number of the plate pairs may vary and a length of the plate pack parts in a longitudinal direction of the plate pack 2 may differ form each other.

The partition plate 5, 5*a*, 5*b*, 5*c* is arranged between the heat exchange plates so that the outer edge of the partition plate is substantially in the same plane with the outer surface of the plate pack. A partition plate or plates arranged between the plate pack parts is used to block a flow connection of the plate pack parts through the flow passages 10*a*, 10*b*. The partition plate comprises required opening(s) for inlet and/or outlet connections in order forming a connection to the flow passage of said plate pack part.

In FIG. 1, one of the connections of the second plate pack part B is arranged so that the connection comprises a connection pipe 8. The other connection 11 is arranged through the end plate 4*b*. A heat exchange medium circuit of the second plate pack part B is formed between the connection 11 and the connection pipe 8, a flow direction may be whichever. A connection pipe 8 is arranged inside a flow passage 10*b* of the first plate pack part A, wherein an end of the connection pipe 8 is attached to the partition plate 5 for forming a connection to the flow passage of the second plate pack part and a second end of the connection pipe 8 elongates through the end plate 4*a* of the outer casing.

In FIG. 1, a heat exchange medium circuit of the first plate pack part A is formed between an inlet connection pipe 15 and the outlet connection 13. The connection pipe 15 is arranged through the outlet connection 13, wherein said connection pipe 15 elongates inside the flow passage 10*a* of the plate pack. An end of the connection pipe 15 is arranged tightly to flow passage e.g. by means of a plate like structure 17. This structure makes possible to arrange the inlet and the outlet connection of the first plate pack part A through the same opening in the end plate of the outer casing and to provide a heat exchange medium circulation inside the plate pack part A.

In FIG. 1, a shell side of plate heat exchanger arrangement comprises one inlet connection 6 and two outlet connection 7*a*, 7*b*. The shell side comprises two passes, which are formed by a stopper plate 12 arranged between an outer surface of the plate pack 2 and an inner surface of the shell 3 for guiding a flow of the shell side heat exchange medium.

In FIG. 2, both an inlet connection and an outlet connection of the second plate pack part B is arranged through the first plate part A. The inlet and the outlet connection of the second plate pack part B is formed by arranging a connection pipe 8, 9 inside the flow passages 10*a*, 10*b* of the first plate pack part A. An end of the connection pipes 8, 9 is attached to the partition plate 5 for forming a connection to said flow passages of the second plate pack part and a second end of the connection pipes 8, 9 elongates through the end plate 4*a* of the outer casing. A heat exchange medium circuit of the second plate pack part B is formed between the connection pipe 8 and the connection pipe 9, a flow direction may be whichever. In FIG. 2, a shell side comprises an inlet connection 6 and an outlet connection 7 arranged through the shell 3 of the outer casing.

Figure 4:
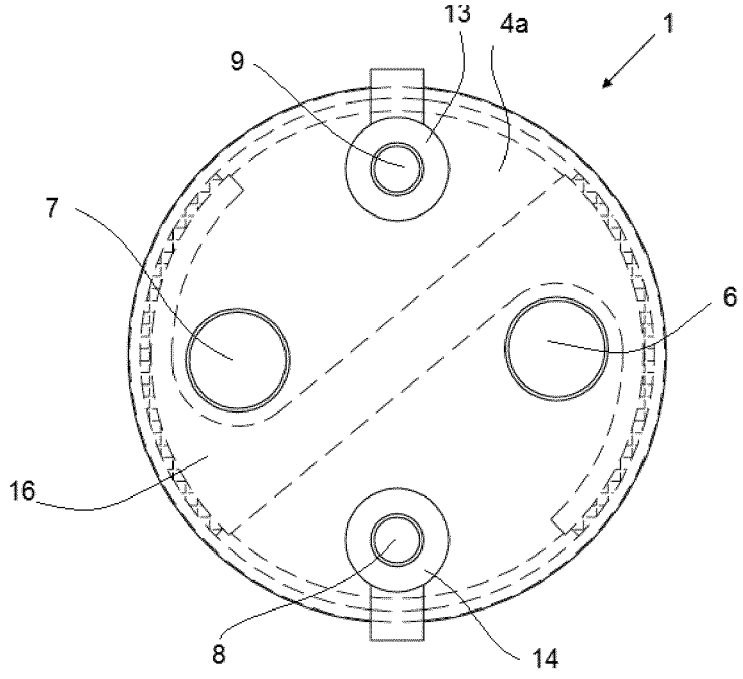
FIG. 4 shows a plate heat exchanger arrangement according to FIG. 3 seen from the end plate of the outer casing, FIG. 5 show plate heat exchanger arrangement according to an embodiment of the present invention, with two partition plates arranged into the plate pack FIG. 6 show plate heat exchanger arrangement according to another embodiment of the present invention, with two partition plates arranged into the plate pack.

FIG. 3 shows similar plate pack parts as FIG. 2, but the shell side connections are arranged at the end plate. FIG. 4 shows the same embodiment seen from the end plate 4*a* of the outer casing. The inlet connection 6 and the outlet connection 7 of the shell side are arranged through the end plate 4*a* of the outer casing. Typically, there is also a flow guide 16 between the inlet and outlet connections of the shell side for guiding the flow of the heat exchange medium to circulate from the inlet connection to the outlet connection. The connection pipes 8, 9 of the second plate pack part B are arranged inside the inlet and outlet connections 13, 14 of the first plate pack part A, wherein all connections of the plate heat exchanger are arranged through the same end plate. This provides a compact structure and enables also an openable structure of the plate heat exchanger.

In an embodiment presented in FIG. 5, one of the connections of the second plate pack part B is arranged so that the connection comprises a connection pipe 8, which is arranged inside the flow passages 10*b* of the first plate pack part A. The other connection 20 of the second plate pack part B comprises a connection pipe 20, which is arranged inside the flow passages 10*a* of the third plate pack part C. A heat exchange medium circuit of the second plate pack part B is formed between the connection pipe 8 and the connection pipe 20, a flow direction may be whichever. An end of the connection pipe 8 is attached to the partition plate 5*a* and an end of the connection pipe 20 is attached to the partition plate 5*b* for forming a connection to the flow passage of the second plate pack part. A second end of the connection pipe 8 elongates through the end plate 4*a* of the outer casing and a second end of the connection pipe 20 elongates through the end plate 4*b* of the outer casing. Inlet and outlet connections of the first plate pack part A are similar as presented in FIG. 1. Inlet and outlet connections of the third plate pack part C are corresponding with the inlet and outlet connections of the first plate pack part A, i.e. a heat exchange medium circuit of the first plate pack part A is formed between an inlet connection pipe 22 and the outlet connection 25. The connection pipe 22 is arranged through the outlet connection 25, wherein said connection pipe 22 elongates inside the flow passage 10*b* of the plate pack of the third plate pack part. An end of the connection pipe 22 is arranged tightly to flow passage e.g. by means of a plate like structure 17.

In FIG. 5, a shell side of plate heat exchanger arrangement comprises an inlet connection 6 and an outlet connection 7. The shell side comprises three passes, which are formed by the stopper plates 12*a*, 12*b* arranged between the outer surface of the plate pack 2 and an inner surface of the shell 3 for guiding a flow of the shell side heat exchange medium.

FIG. 6 shows corresponding structure as FIG. 5, but the connection pipe 20 of the second plate pack part B is arranged inside the flow passages 10*b* of the third plate pack part C. Connection pipes 8, 20 of the second plate pack part B are now arranged through the same flow passage and so it is required to arranged a dividing plate 21 inside the flow passage 10*b* of the second plate part B for guiding a flow of the heat exchange medium inside the second plate pack part B.

FIG. 7 shows an embodiment, in which the second plate pack part B and the third plate pack C comprises inlet and outlet connections which are arranged through the flow passages of the plate pack parts arranged between the end plate of the outer casing and the partition wall. A second plate pack part B comprises connection pipes 8, 9 arranged to the flow passages of the first plate pack part A, and the third plate pack part C comprises connection pipes 18, 19 arranged to the flow passages of the fourth plate pack part D. The connection pipes 8, 9 of the second plate pack part B are arranged inside the inlet and outlet connections 13, 14 of the first plate pack part A, and the connection pipes 18, 19 of the third plate pack part C are arranged inside the inlet and outlet connections 23, 24 of the fourth plate pack part D, wherein all connections of the plate heat exchanger are arranged through the end plates 4*a*, 4*b*.

In an embodiment presented in FIG. 7, an inlet and outlet connections 6, 7 of the shell side is also arranged at the end plates 4*a*, 4*b*.

As shown in Figures, an outer diameter of the connection pipe 8, 9, 18, 19, 20 is smaller than a diameter of the flow passage 10*a*, 10*b* of the plate pack.

The plate heat exchanger arrangements presented in FIGS. 1-3 may form a plate heat exchanger as such or they may be a part of the modular structure. In modular structures, the plate heat exchanger arrangement presented in FIGS. 1-3 may be one module of the modular structure, and the end plate 4*b* forms a partition wall between the arrangement and the second module of the modular structure.

The invention claimed is:

1. A plate heat exchanger arrangement comprising:

a plate pack comprising a plurality of heat exchange plates having at least two openings defining flow passages, wherein the heat exchange plates are arranged on top of each other to define a longitudinal direction, wherein the plate pack comprises ends spaced apart from one another in the longitudinal direction of the heat exchange plates, and wherein the heat exchange plates are attached to each other as plate pairs defining spaces therebetween and include inner parts thereof which are arranged in connection with each other via the flow passages formed by the at least two openings of the heat exchange plates, an outer casing surrounding the plate pack, wherein the outer casing comprises end plates spaced apart from one another in the longitudinal direction of the plate pack, and a shell connecting the end plates, primary inlet and an outlet connections for a heat exchange medium arranged through the outer casing, wherein the outer casing, the primary inlet connection and the primary outlet connection are arranged to connect with the spaces between the plate pairs of the plate pack, and at least one partition plate arranged between the heat exchange plates of the plate pack which divides the plate pack into separate plate pack parts, wherein the plate heat exchanger arrangement further comprises secondary inlet and outlet connections for each of the separate plate pack parts which are arranged to connect the inner parts of the plate pairs of the respective plate pack part, and wherein at least one of the secondary inlet or outlet connections of the separate plate pack parts comprises a connection pipe which is arranged inside a flow passage of the respective plate pack part between the end plate of the outer casing and the partition plate, and wherein the connection pipe has first and second ends such that the first end of the connection pipe is attached to the partition plate for forming a connection to the flow passage of the plate pack part and the second end of the connection pipe extends through the end plate of the outer casing.

2. The plate heat exchanger arrangement according to claim 1, wherein the connection pipe has an outer diameter smaller than a diameter of any of the flow passages of the plate pack.

3. The plate heat exchanger arrangement according to claim 1, wherein the partition plate is arranged between the heat exchange plates so that the outer edge of the partition plate is substantially aligned with the outer surface of the plate pack.

4. The plate heat exchanger arrangement according to claim 1, wherein the arrangement further comprises at least one stopper plate arranged between an outer surface of the plate pack and an inner surface of the shell for arranging multiple passes in the shell side of the heat exchanger.

5. The plate heat exchanger arrangement according to claim 1, wherein the plate pack comprises one partition plate, and wherein the separate plate pack parts comprise a first plate pack part and a second plate pack part, and wherein a respective secondary inlet connection or a respective secondary outlet connection of the second plate pack part comprises the connection pipe which is arranged inside a flow passage of the first plate pack part between the end plate of the outer casing and the one partition plate.

6. The plate heat exchanger arrangement according to claim 5, wherein the respective secondary inlet connection of the first plate pack part is formed by arranging the connection pipe through the secondary outlet connection of the first plate pack part arranged at the end plate of the outer casing, and wherein the connection pipe extends inside the flow passage of the first plate pack part.

7. The plate heat exchanger arrangement according to claim 1, wherein the plate pack comprises one partition plate, and wherein the separate plate pack parts comprise a first plate pack part and a second plate pack part, and wherein a respective secondary inlet and outlet connection of the second plate pack part comprise the connection pipe which is arranged inside a flow passage of the first plate pack part between the end plate of the outer casing and the one partition plate.

8. The plate heat exchanger arrangement according to claim 1, wherein the plate pack comprises two partition plates, wherein the separate plate pack parts comprise a first plate pack part, a second plate pack part and a third plate pack part, and wherein a respective secondary inlet and outlet connection of the second plate pack part in a central part of the plate pack comprise the connection pipe which is arranged inside a flow passage of the first plate pack part and/or the third plate pack part.

9. The plate heat exchanger arrangement according to claim 8, wherein the respective secondary inlet connection of the first plate pack part and the respective secondary inlet connection of the third plate pack part are formed by arranging the connection pipe through the respective secondary outlet connection of the plate pack part arranged at the end plate of the outer casing, wherein the connection pipe extends inside the flow passage of the plate pack part.

10. The plate heat exchanger arrangement according to claim 1, wherein the plate pack comprises three partition plates, and wherein the separate plate pack parts comprise a first plate pack part, a second plate pack part, a third plate pack part and a fourth plate pack part, and wherein a respective secondary inlet and outlet connection of the second plate pack part and the third plate pack part in a central part of the plate pack comprise the connection pipe which is arranged inside a flow passage of the first plate pack part or the fourth plate pack part.

11. A modular structure which comprises at least two modules arranged inside the same outer casing structure which are separated from each other by a partition wall, wherein at least one module of the at least two modules comprises a plate heat exchanger arrangement according to claim 1.

12. The modular structure according to claim 11, wherein the outer casing structure of the modules is continuous in a lengthwise dimension of the modular structure.

13. The modular structure according to claim 11, wherein the partition wall between the plate heat exchanger arrangement and an adjacent module is the end plate of the outer casing of the plate heat exchanger arrangement.

* * * * *